US010179266B2

(12) United States Patent
Burke

(10) Patent No.: US 10,179,266 B2
(45) Date of Patent: Jan. 15, 2019

(54) LIGHTWEIGHT TRAINING BALL WITH INNER AND OUTER LAYERS

(71) Applicant: Joseph Gerard Burke, Yorba Linda, CA (US)

(72) Inventor: Joseph Gerard Burke, Yorba Linda, CA (US)

( * ) Notice: Subject to any disclaimer, the term of this patent is extended or adjusted under 35 U.S.C. 154(b) by 0 days.

(21) Appl. No.: 15/788,228

(22) Filed: Oct. 19, 2017

(65) Prior Publication Data

US 2018/0104545 A1 Apr. 19, 2018

Related U.S. Application Data

(63) Continuation-in-part of application No. PCT/US2017/026858, filed on Apr. 10, 2017, and a continuation-in-part of application No. 15/296,025, filed on Oct. 17, 2016, now abandoned.

(51) Int. Cl.

| | |
|---|---|
| ***A63B 41/02*** | (2006.01) |
| ***A63B 37/12*** | (2006.01) |
| *A63B 41/08* | (2006.01) |
| *A63B 43/00* | (2006.01) |

(52) U.S. Cl.

CPC ..... *A63B 41/02* (2013.01); *A63B 37/12* (2013.01); *A63B 41/08* (2013.01); *A63B 43/008* (2013.01); *A63B 2043/001* (2013.01); *A63B 2209/00* (2013.01)

(58) Field of Classification Search

CPC ..... A63B 41/00; A63B 41/02; A63B 41/08; A63B 41/085; A63B 41/04; A63B 2041/005; A63B 43/008; A63B 45/00; A63B 2209/02

See application file for complete search history.

(56) References Cited

U.S. PATENT DOCUMENTS

| | | | | |
|---|---|---|---|---|
| 1,505,802 A * | 8/1924 | Pierce | A63B 41/085 473/603 |
| 3,942,793 A | 3/1976 | Lombardo | |
| 4,065,126 A * | 12/1977 | Mantz | A63B 37/12 473/237 |
| 4,257,598 A * | 3/1981 | Massino | A63B 37/00 273/DIG. 20 |
| 4,261,565 A * | 4/1981 | Massino, Sr. | A63B 37/06 156/186 |

(Continued)

OTHER PUBLICATIONS

Website: www.victury.com Video: https://youtu.be/GXIWpSLRFac.

*Primary Examiner* — Steven B Wong

(74) *Attorney, Agent, or Firm* — Viking IP Law; Scott R. Hansen

(57) ABSTRACT

A ball has a lightweight inner bladder and an outer layer that covers the inner bladder. The inner bladder bunches up against the inner surface of the outer layer. The bunched up surface of the inner bladder may be flattened upon impact, thereby absorbing energy. The bunched up inner bladder may create an uneven surface on the outer layer thereby altering the manner through which the ball travels through the air. The outer layer may be provided with lines, indentations, graphics and/or other features that improve the performance of the ball and/or that replicate some or all of the characteristics of the exterior surface of the regulation ball it simulates. The ball may be configured for any of a variety of sports or games.

18 Claims, 8 Drawing Sheets

(56) References Cited

U.S. PATENT DOCUMENTS 4,337,944 A * 7/1982 Massino ..... A63B 37/00 273/DIG. 20
4,462,589 A 7/1984 Morgan
4,542,902 A * 9/1985 Massino ..... A63B 37/02 273/DIG. 20
4,738,450 A * 4/1988 Wexler ..... A63B 37/06 273/DIG. 20
4,834,382 A * 5/1989 Spector ..... A63B 41/02 273/DIG. 20
5,035,426 A * 7/1991 Spector ..... A63B 41/02 273/DIG. 20
5,138,721 A 8/1992 Spector
5,286,020 A * 2/1994 Caruso ..... A63B 41/00 473/603
5,335,907 A 8/1994 Spector
5,380,002 A 1/1995 Spector
5,462,273 A 10/1995 Spector
5,588,648 A 12/1996 Stebbins
6,402,647 B1 * 6/2002 Haseltine ..... A63B 41/00 473/423
7,740,552 B2 * 6/2010 Spector ..... A63B 41/00 473/594
8,272,980 B1 * 9/2012 Johnson ..... A63B 41/08 473/573
8,342,991 B2 * 1/2013 Spector ..... A63B 41/00 473/576
9,242,149 B2 1/2016 Carter
2002/0077201 A1 * 6/2002 Davies ..... A63B 41/02 473/604
2004/0087396 A1 5/2004 Chan
2007/0060426 A1 * 3/2007 Maziarz ..... A63B 41/08 473/605
2008/0242458 A1 * 10/2008 Winn ..... A63B 41/00 473/599
2008/0268990 A1 10/2008 Todokoro
2008/0287218 A1 11/2008 Freund
2009/0286632 A1 11/2009 Laliberty
2010/0317472 A1 12/2010 Maziarz
2012/0283050 A1 11/2012 Brundage
2015/0126312 A1 5/2015 Mayer

* cited by examiner

LIGHTWEIGHT TRAINING BALL WITH INNER AND OUTER LAYERS

CROSS-REFERENCE TO RELATED APPLICATIONS

This application is a continuation-in-part of Patent Cooperation Treaty application PCT/US17/26858, which was filed Apr. 10, 2017, entitled "Training Ball for Indoor Use and Method for Training" and which designates the United States. This application is also a continuation-in-part of U.S. patent application Ser. No. 15/296,025, filed Oct. 17, 2016, entitled "Training Ball for Indoor Use and Method for Training With a Lightweight Ball," which claims priority from U.S. Provisional Application 62/241,882. All of the foregoing are incorporated by reference herein.

TECHNICAL FIELD OF THE INVENTION

The present invention relates to a lightweight ball that may be used for exercise and/or play and, in particular, to a lightweight ball having an outer layer and an inner bladder.

BACKGROUND

Athletes who play sports that include hitting or kicking a ball tend to spend many hours training. There are many devices to facilitate training, such as balls attached to bungee cords, balls attached to fulcrums, rolling half-spherical balls and rebounding nets. These devices are often used outdoors or in an indoor stadium or other training space. When such devices are used in most indoor settings, damage to walls, ceilings, other structural components—as well as to related objects, such as lamps, pictures, windows, drinking glasses, etc.—can occur.

As an alternative and in order to limit the possibility of damage, the athlete could use a balloon or beach ball indoors. The exterior of balloons and beach balls do not replicate the exterior of an actual sports ball. Also, the valve, balloon knot and shape can cause the balloon or beach ball to spin lopsidedly and out of balance.

What is needed is a ball that has a shape and weight that allows for an accurate simulation of real ball handling, while limiting the potential damage the ball can do in an indoor environment such as a house.

BRIEF SUMMARY

In one embodiment, a ball for training and/or play has a flexible outer layer and an inflatable inner bladder. The outer surface of the inner bladder is bunched up against the inner surface of the outer layer. At least a portion of the bunched up outer surface of the inner bladder is adapted to at least partially change configuration to absorb energy upon impact. The bunched up inner bladder may create an uneven surface on the outer layer, such as a ripple, for example. The uneven surface of the outer layer is adapted to reduce the speed of ball as it travels through the air. The bunched up inner bladder may act as a cushion, and the inner bladder may be made of a metalized film, for example.

Various other features may be added, either in combination or individually. The inner bladder may be partially inflated, or may be fully inflated.

In another embodiment, a ball for training and/or play includes a flexible outer layer having a diameter, and an inflatable inner bladder, the inner bladder having a diameter greater than the diameter of the outer layer. The outer surface of the inner bladder is bunched up against the inner surface of the outer layer. At least a portion of the bunched up outer surface of the inner bladder is adapted to at least partially change configuration to absorb energy upon impact. The change of configuration may be described as flattening, unbunching, and/or expanding the bunched surface.

Added features may include one or more of the following. The inner bladder may be fully inflated or partially inflated. The bunched up inner bladder may create an uneven surface on the outer layer, such as a ripple or other effect. The uneven surface may be adapted to reduce the speed of ball as it travels through the air. The bunched up inner bladder may act as a cushion. The inner bladder may be formed with a metalized film. The exterior layer may be formed from lightweight high-density polyethylene fibers.

In a further embodiment, a ball for training and/or play includes a flexible outer layer having a diameter and an inflatable inner bladder. The outer surface of the inner bladder may be bunched up against the inner surface of the outer layer. At least a portion of the bunched up outer surface of the inner bladder is adapted to at least partially change configuration to absorb energy upon impact.

Again, the disclosed concept includes variations, and the optional features noted above may be added to embodiments of the invention, either alone or in various combinations as appropriate.

A further understanding of the nature and advantages will become apparent by reference to the remaining portions of the specification and drawings.

DETAILED DESCRIPTION

In one embodiment of the invention, a ball according to the present invention is designed for indoor and in-home use as it is a regulation-sized, spherical ball that weighs slightly heavier than a latex balloon. Alternatively, the ball can also be used competitively in a game or sport.

In a preferred embodiment, the ball is constructed of two or more layers of material that are designed to spin, balance and physically react similarly to a regulation soccer or volleyball that conforms to specifications of a standards body. In one embodiment, the ball is inflated with a standard drinking straw that is inserted into a self-closing valve on the inflation port, the inner bladder being, in one embodiment, a balloon of a metalized film, such as for example Mylar or Mylar-type material. The ball is filled with air, nitrogen, helium or other gas that, in combination with materials and/or ball construction, produce a desired "gravity" or weight.

Figure 2:
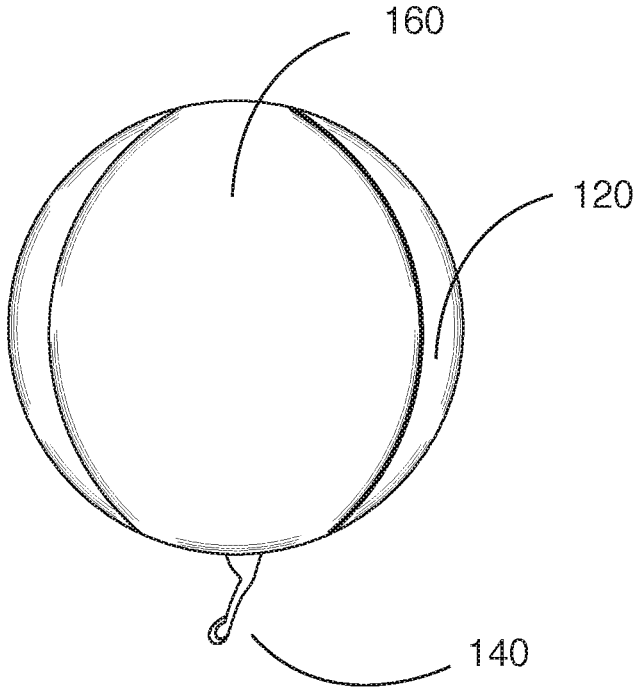
FIG. 2. is a view of the ball of FIG. 1 in which the inner bladder is exposed for illustrative purposes and an inflation stem is shown extended so that the bladder may be inflated.
Figure 3:
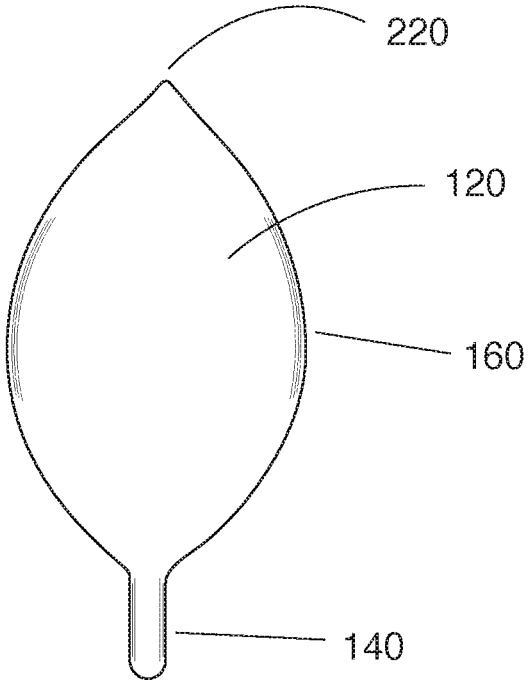
FIG. 3 illustrates one embodiment of an uninflated inner bladder.

Considering the drawings of a presently preferred embodiment, a training ball 100 includes an inner bladder 120 (FIG. 2) that has an inflation port 140 tucked within opening 150. The inflation port 140 may be pulled out from opening 150 for inflation or deflation of the ball 100 (FIG. 2). The inflation port 140 allows the bladder 120 (FIGS. 2, 3) to be filled with air, nitrogen, helium or other gas, as desired. The port 140 includes a valve, which may be visible or not depending on the manufacturer and material(s) used. As noted, a straw or other device may optionally be inserted into the port 140 to facilitate inflation by blowing into the bladder. If a straw, it may optionally be custom-made for use with the ball.

Figure 1:
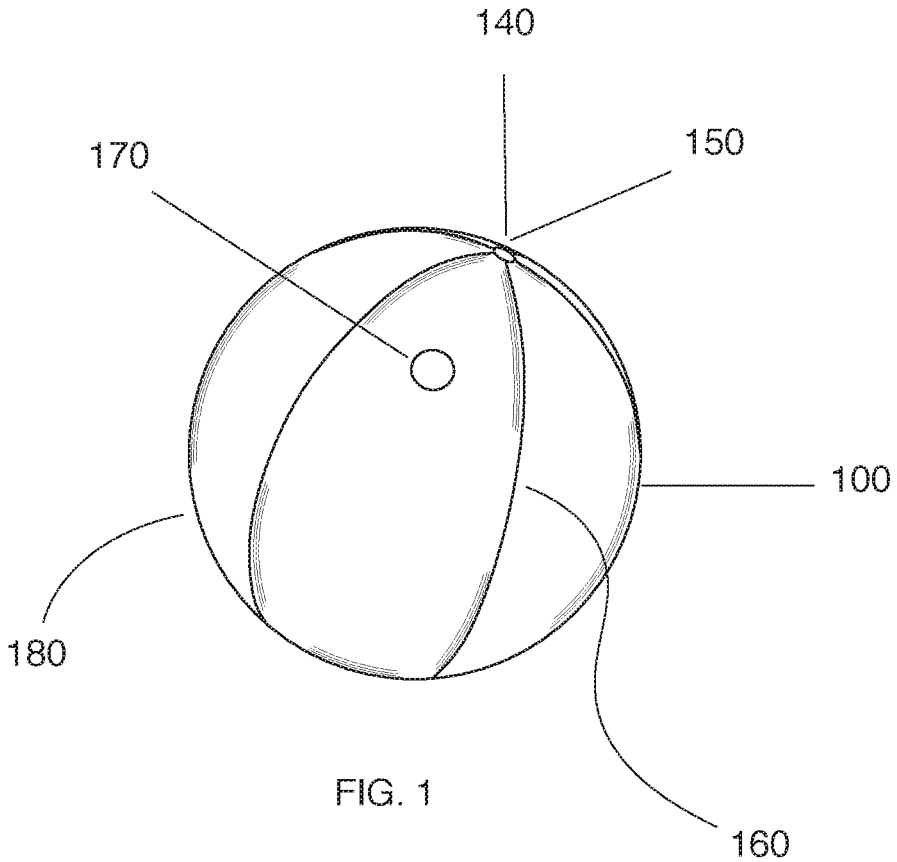
FIG. 1 illustrates a training ball according to one embodiment of the invention in which the ball has multiple panels, an inflation port to fill an inner bladder, and indicia printed thereon.

The ball 100 may also include design and visuals that may be, for example, lines (printed, molded, intruded or extruded) or other shapes, that give a visual reference to the user and/or give the ball balanced properties when the ball is spinning. In FIG. 1, lines 160 may be imprinted on or molded into the exterior surface of outer layer 180 of the ball. Although the lines 160 are shown to extend about the circumference in a straight manner, the lines may alternatively be curved and/or another shape. Alternatively, the lines 160 may be seam lines connecting multiple panels to form the exterior surface of the ball. Indicia 170 which, in this case, is a printed colored dot, may be included to give the user a visual effect that may enhance the training such as, for example, allowing the user to better view the spin of the ball during use.

The ball is best produced through a material formation device. This could be but not limited to plastic injection molding, foam molding, vulcanization or other technique specific to manufacturing that accomplishes the size and weight requirements of the training system.

The outer layer 180 of the ball 100 may have measurements that match the circumference of an actual sports ball. That is, as just one non-limiting example, the training ball may have a circumference of 68-70 cm to correspond to the circumferences of a regular sports ball. The weight of the ball may be varied. There could be, for example, a set of balls that have weights between less than 1 ounce up to about 8 ounces to simulate different levels of "gravity." The outer layer 180 is typically made of a lightweight synthetic woven material, or other suitable lightweight material.

In one specific embodiment, the training ball 100 includes a heat seamed, 4-panel inner bladder 160 that inflates to about 70 cm in circumference. The bladder 160 is made of a material such as Mylar or other material suitable for a bladder. The exterior may be a sewn, 6-panel outer shell that is about 70 cm in circumference when the bladder is inflated. One non-limiting example of a suitable exterior surface is one made of Tyvek 1443R, although other types of Tyvek or synthetic woven materials or other suitable materials may be used.

In another non-limiting embodiment, the inner bladder has an uninflated dimension of about 7 inches or 17.5 centimeters at its widest point, and a length of about 14 inches or 35 centimeters, not including the length of the inflation port. The inner bladder is then inflatable to a circumference of about 70 cm.

The inflatable bladder 160 is lightweight, and includes an inflation valve or port 14 that is a self-closing. The valve typically does not add any significant weight to the ball and does not alter the balance of the spin of the ball. The outer surface 200 of the bladder is situated within the outer layer 180. The bladder may optionally be secured within the outer layer 180 with adhesive, for example, applied at point 220 and/or at other locations on the bladder.

The exterior surface of outer layer 180 may also include designs and/or visuals, such as lines 160. For example, the exterior surface may include lines (printed, molded, intruded or extruded), that give a visual reference to the user and/or give the ball balance properties when the ball is spinning. The exterior surface may also include printed indicia that, for example, assists the user in seeing the ball or a portion thereof.

Figure 4:
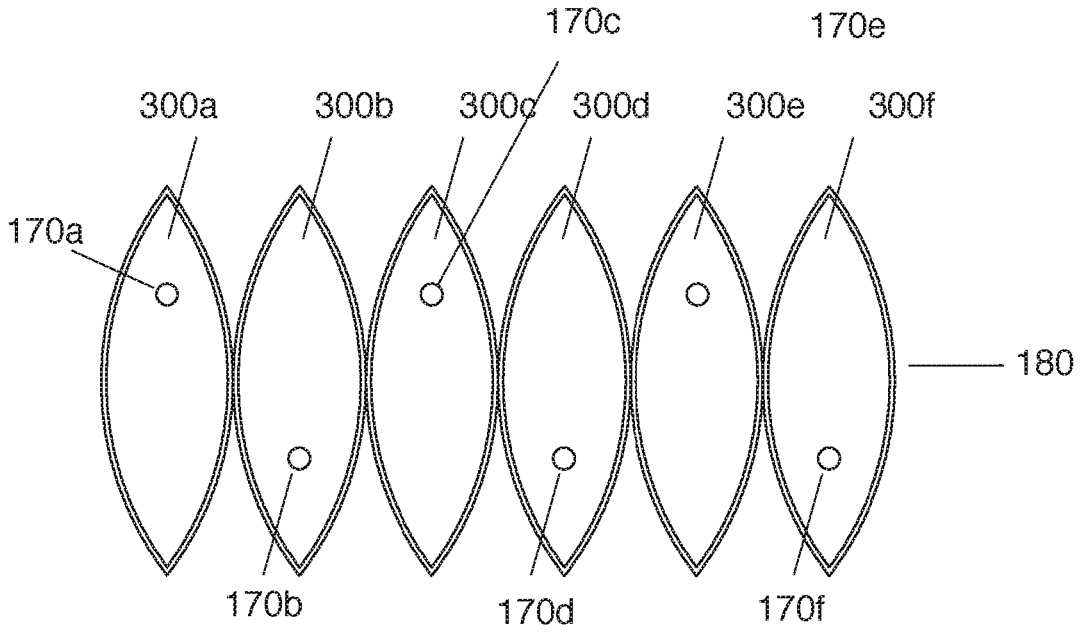
FIG. 4 illustrates panels that may be sewn together to form an exterior covering of the training ball.
Figure 5:
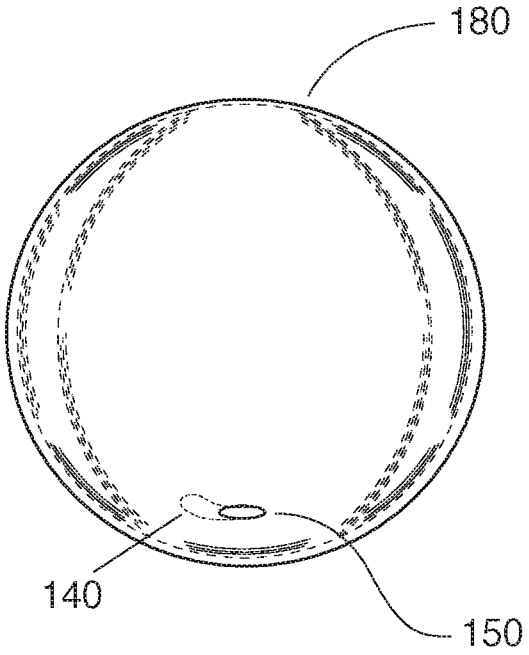
FIG. 5 illustrates the training ball of FIG. 2 after inflation and with the inflation port tucked into exterior surface of the ball.
Figure 6:
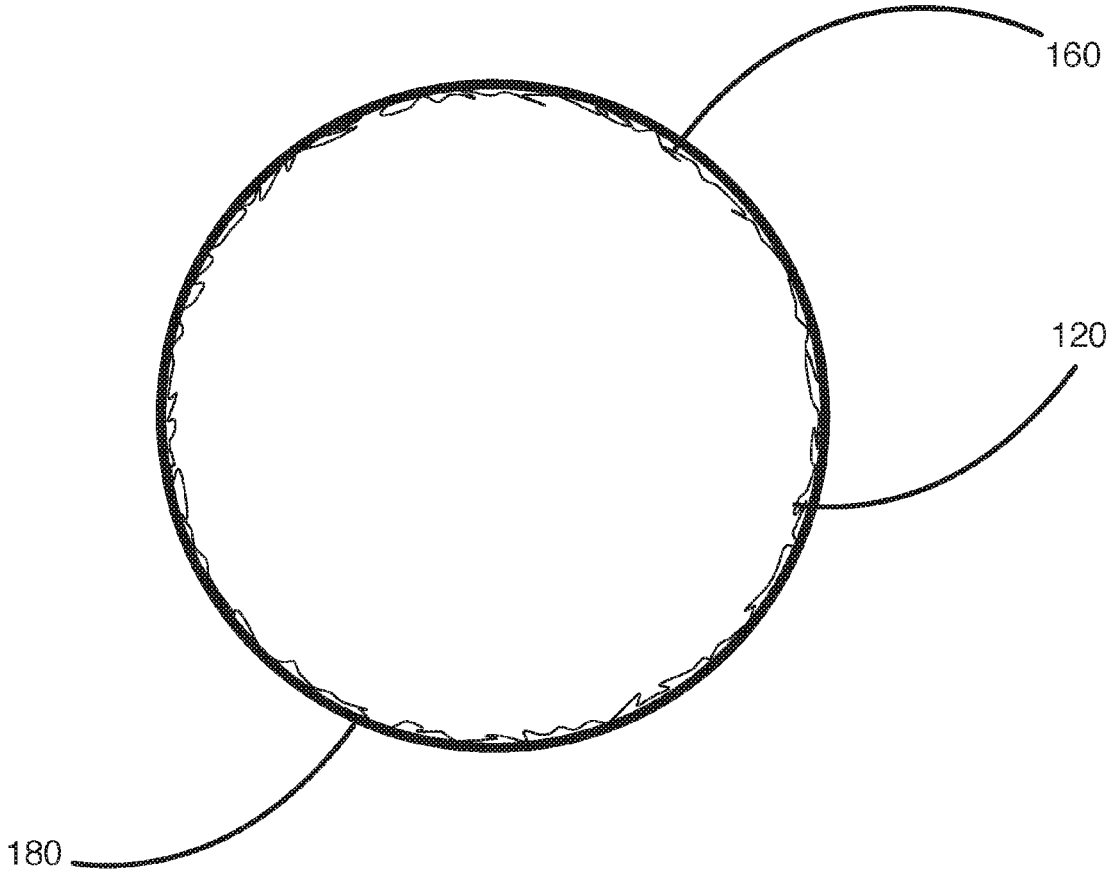
FIG. 6 is a cross-section of a ball illustrating a bunched up surface of the inner bladder against the inner surface of the outer layer.

FIG. 4 illustrates a panel of portions 300*a-f* which, when sewn or otherwise manipulated and secured forms an exterior layer 380. The precise nature of each of the panels 30*a-f* may vary for different types of balls and/or the desired properties of the ball. For example, the exterior surface of the outer layer 380 may be roughened and/or have shapes extending from or indented into the surface. The surface may mirror the surface of the type of ball it seeks to replicate, having an external surface that appears to be a soccer ball, a volleyball, or whatever type of ball of the sport for which the user is training.

In one embodiment, using the ball would simulate playing with an actual sports ball (e.g. a soccer ball) in a low-gravity environment. Being lightweight and having a low gravity motion, the ball may "float" when hit or kicked, and give the user(s) time to react and adjust their movements for increased skill training, fitness and/or physical therapy, for example. In that regard, various embodiments of a training ball according to the present invention may have different weights. As the user(s) increases skill level, the user may use a heavier ball with less "low-gravity" effect. This brings the weight of the ball closer to a real regulation sports ball. So, for example, whereas a regulation soccer ball may be 16 ounces in weight, for example, a training ball according to the present invention may range from about 0.3 ounces to about 8 ounces. The heavier ball may more closely replicate an actual soccer ball, but still be lighter in weight and more suitable than an actual soccer ball for training indoors.

Considering the invention further, an athlete is provided with a "reduced-gravity" ball that allows the user to more easily react to the ball's movement and accelerating skills than a regulation ball. A training system may be provided to coach the user through a series of drills and fitness exercises with the ball. The "anti-gravity" ball may come in several weights that train the user by gradually using heavier balls that have more "gravity." In one embodiment, the training ball is safe indoors, similar to playing with a balloon but having an outer surface that better simulates an actual playing ball. In this respect, balls according to the present invention may be used by athletes, coaches, military instructors, fitness seekers, and/or persons with injuries or disabilities. The training ball may lead to rapid improvement of ball-handling skills, hand-eye coordination, and/or fitness, may be used in physical therapy. Embodiments of the invention may be adapted to be used indoors during inclement weather.

Considering an American football version of a training ball, as just one non-limiting example, the training ball may have a circumference of 22 inches and 11 inches tip-to-tip to correspond to the circumferences of a regular football. In one embodiment, using the ball would simulate playing with an actual football in a low-gravity environment. Being lightweight and having a low gravity motion, the ball may "float" when hit or kicked, and give the user(s) a simulated but accurate ball reaction and spin of an actual kicked football in a field goal or punting situation. For instance, whereas a regulation football (e.g. a football that conforms to regulations as to dimension and/or weight) may be 14 ounces in weight, for example, a training ball according to the present invention may range from about 0.3 ounces to about 8 ounces. A heavier training ball may more closely replicate an actual football, but still be lighter in weight and more suitable than an actual football for training indoors.

In another embodiment, the exterior of the ball can be customized through printing on the outer shell. The printing may be done with a printer or by hand. In one example, the exterior of the ball includes an outline drawing and a user then uses markers, crayons or other marking devices to customize the appearance of the ball themselves, analogous to coloring in a coloring book.

Embodiments may be more buoyant in air than the corresponding regulation ball. That is, for example, a football version of the present invention may be more buoyant in air than a regulation football of the same dimension. This can give the ball an "anti-gravity" effect. The buoyancy may be as great as neutral—in which case the "anti-gravity" effect would be pronounced. But most embodiments will have less-than-neutral buoyancy in air, such that the ball will fall to the ground when dropped, but may fall more slowly than a regulation ball. The buoyancy can be controlled by, for example, the type of gas(es) used to fill the inner balloon. Consequently, the ball may be made to have significant hang time (e.g. filled with helium or other lighter-than-air gas or mix of gasses) or less hang time (e.g. filled with air), as desired. As a further alternative, the ball may be designed to have a buoyancy approximately the same as a regulation ball to simulate the rise and fall of a regulation ball.

One particular embodiment includes an inner bladder 120 made of a metallized film such as Mylar, for example, or other acceptable material, and an outer layer 180. The bladder 120, when fully inflated, would have a diameter greater than that of the outer layer 180. The outer layer 180 constrains the degree to which the inner bladder 120 can be inflated. Consequently, there is a surplus of material in the inner bladder (FIG. 7), creating a bunched up surface 200 of the inner bladder. This may optionally alter the surface of the outer layer 180, and provide unique cushioning or other properties when the ball is kicked or hit. The bladder may be a balloon, most typically a balloon made from a metalized material such as Mylar.

For instance, the surface of the outer layer may become uneven, such as the surface of the inner bladder creating ripples or other shapes on the surface of the outer layer. This may create additional air resistance when the ball moves through space, slowing the ball and/or affecting its trajectory, such as causing the ball to curve while in flight. Unlike a smooth-surfaced beach ball, sports ball or balloon, this additional air resistance, or skin friction, slows the movement of the ball. The ball may be adapted to react and spin like a typical sports ball.

Figure 7:
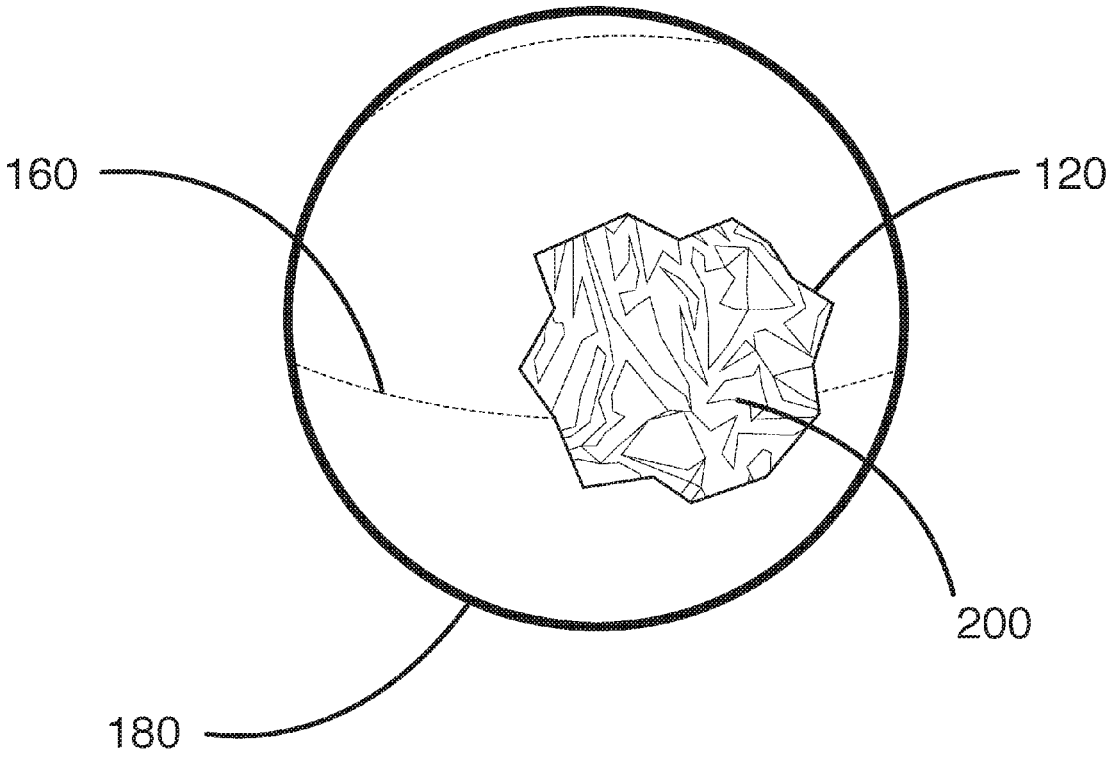
FIG. 7 is a cut-away view illustrating the bunched up surface of the inner bladder against the inner surface of the outer layer.
Figure 8:
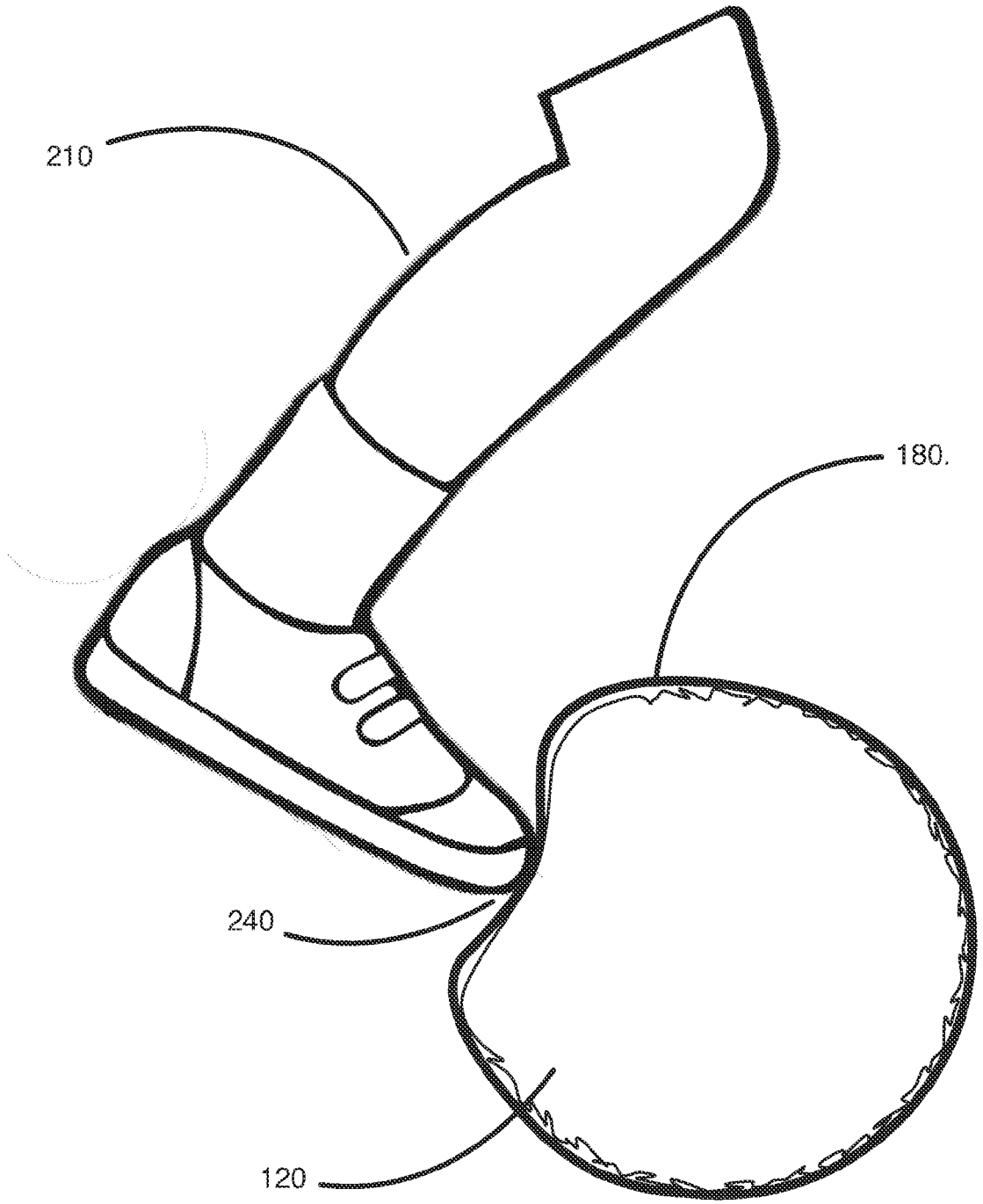
FIG. 8 illustrates a flattening of the bunched up surface of the inner bladder when the ball is impacted.

In one embodiment illustrated in FIG. 8, the outer casing/layer 180 of the ball 100 is constructed of a durable and lightweight material. The interior bladder 120 is an oversized bladder that, when inflated, bunches and "crunches" up the excess material to create folds and/or other structures against the inner surface of the outer casing (FIG. 7). When a hand, foot or object impacts the ball at an impact area 40 (FIG. 8), the bunched material of the inner bladder allows for shock absorption. That is, the bunched material may "unbunch" and/or flatten and/or expand or the like, so as to absorb energy. As FIG. 9 illustrates, in one embodiment of the present invention, the bunched material 200 on the inner bladder 120 changes configuration, e.g. flattens and/or expands and/or "unbunches" upon impact, absorbing energy and dampening the "trampoline effect" of the impact on the ball. See FIG. 8 for a foot kicking one embodiment of a ball according to the present invention at point 240.

In another embodiment, the surface 200 of the inner bladder becomes bunched up and/or has folds when the inner bladder is underinflated. This is an alternative approach to creating an uneven surface on the inner bladder.

The balls of the present invention may be provided in conjunction with an instructive or training video, provided on a DVD, online, or the like. The instructive video may present tips, tricks, drills, and/or other material useful to the end user. Consequently, the present invention encompasses using the ball in conjunction with a training video.

In view of the many possible embodiments to which the disclosed principles may be applied, it should be recognized that the illustrated embodiments are only preferred examples and should not be taken as limiting the scope of the disclosure. Rather, the scope is defined by the following claims. We therefore claim all that comes within the scope and spirit of these claims.

What is claimed is:

1. A ball for training and/or play, comprising:

a flexible outer layer having an inner surface;

an inflatable inner bladder;

substantially all of the outer surface of the inner bladder when inflated is adapted to be bunched up against the inner surface of the outer layer; and at least a portion of the bunched up outer surface of the inner bladder being adapted to at least partially change configuration to absorb energy upon impact;

wherein:

the bunched up inner bladder creates an uneven surface on the outer layer;

there is no additional material in between the inner bladder and outer layer;

the inner bladder is inflatable with gas and there is no filler material or stuffing within the inner bladder;

the uneven surface of the outer layer is adapted to reduce the speed of ball as it travels through the air; and the inner bladder comprises a metalized film.

2. The ball of claim 1, wherein the inner bladder is fully inflated to the extent permitted by at least one of the shape and size of the outer layer.

3. A ball for training and/or play, comprising:

a flexible outer layer having a diameter;

an inflatable inner bladder, the inner bladder having a diameter when the inner bladder is unconstrained and inflated that is sufficiently greater than the diameter of the outer layer such that when the inner bladder is inside the outer layer, the inner bladder is adapted to bunch up against the inner surface of the outer layer upon inflation of the inner bladder;

the outer surface of the inner bladder being bunched up against at least most of the inner surface of the outer layer; and the bunched up outer surface of the inner bladder being adapted to at least partially change configuration to absorb energy upon impact.

4. The ball of claim 3, wherein the inner bladder is fully inflated to the extent permitted by at least one of the shape and size of the outer layer.

5. The ball of claim 3, wherein the bunched up inner bladder creates uneven surface on at least most of the outer layer.

6. The ball of claim 5, wherein the uneven surface is adapted to reduce the speed of the ball as it travels through the air.

7. The ball of claim 3, wherein the bunched up inner bladder acts as a cushion.

8. The ball of claim 3, wherein the inner bladder comprises a metalized film.

9. The ball of claim 3, wherein the exterior layer comprises lightweight high-density polyethylene fibers.

10. The ball of claim 3, wherein the inner bladder is at least partially inflated with helium.

11. A ball for training and/or play, comprising:

a flexible outer layer having a diameter;

an inflatable inner bladder;

at least most of the outer surface of the inner bladder being bunched up against the inner surface of the outer layer;

at least a portion of the bunched up outer surface of the inner bladder being adapted to at least partially change configuration to absorb energy upon impact;

wherein the inner bladder is inflatable with gas and there is no filler material or stuffing within the inner bladder;

wherein the inner bladder has an unconstrained diameter when fully inflated of at least 1.25 times greater than the diameter of the outer layer.

12. The ball of claim 11, wherein the bunched up inner bladder creates uneven surface on the outer layer.

13. The ball of claim 11, wherein the surface of the inner bladder is a metalized film.

14. The ball of claim 11, wherein the change of configuration is comprised of at least one of flattening, expanding, and unbunching of the outer surface of the inner bladder.

15. The ball of claim 1, wherein the inner bladder has an unconstrained diameter when fully inflated of at least 1.25 times greater than the diameter of the outer layer.

16. The ball of claim 3, wherein the inner bladder has an unconstrained diameter when fully inflated of at least 1.25 times greater than the diameter of the outer layer.

17. The ball of claim 3, wherein the inner bladder is fillable with gas and there is no filler material or stuffing within the inner bladder.

18. The ball of claim 11, wherein substantially all of the outer surface of the inner bladder is bunched up against substantially all of the inner surface of the outer layer.

* * * * *